US005629518A

United States Patent [19]

Grotheer et al.

[11] Patent Number: 5,629,518

[45] Date of Patent: May 13, 1997

[54] PROCESS AND APPARATUS FOR DETECTING SAMPLE MOLECULES IN A CARRIER GAS

[75] Inventors: Horst-Henning Grotheer, Stuttgart; Harald Oser, Ostfildern; Reinhold Thanner, Stuttgart, all of Germany

[73] Assignee: Deutsche Forschungsanstalt fuer Luft-und Raumfahrt e.V., Bonn, Germany

[21] Appl. No.: 562,265

[22] Filed: Nov. 22, 1995

[30] Foreign Application Priority Data

Nov. 25, 1994 [DE] Germany ..... 44 41 972.4

[51] Int. Cl.[6] ..... H01J 49/10; H01J 49/40

[52] U.S. Cl. ..... 250/288; 250/287

[58] Field of Search ..... 250/288, 288 A, 250/287

[56] References Cited

U.S. PATENT DOCUMENTS 4,365,157 12/1982 Unsold et al. ..... 250/287

5,496,998 3/1996 Bergmann ..... 250/287

OTHER PUBLICATIONS

Lubman et al, Review of Scientific Instruments 56 (3), Mar. 1985, pp. 373–376.

*Primary Examiner*—Jack I. Berman

*Attorney, Agent, or Firm*—Barry R. Lipsitz

[57] ABSTRACT

In order to improve a process for detecting sample molecules in a carrier gas, wherein a divergent stream of carrier gas is generated by means of expansion of the carrier gas through a nozzle into a vacuum, the sample molecules are ionized selectively to form sample molecule ions in an ionization zone of the stream of carrier gas by absorption of photons and the sample molecule ions are drawn by an electrical pulling field into a mass spectrometer, such that the sensitivity of the process is distinctly increased without forfeiting selectivity, it is suggested that a continuum zone of the stream of carrier gas, in which the temperature of the carrier gas decreases with increasing distance from an exit aperture of the nozzle, a molecular beam zone of the stream of carrier gas, in which the temperature of the carrier gas does not essentially decrease any further with increasing distance from the exit aperture of the nozzle, and a boundary between the continuum zone and the molecular beam zone be determined and that the sample molecules be ionized in an ionization zone near to the boundary between the continuum zone and the molecular beam zone.

47 Claims, 6 Drawing Sheets

ION SIGNAL ( ARBITRARY UNITS )
400
300
200
100
0
2
3
4
5
6
x (cm)

ION SIGNAL ( ARBITRARY UNITS )
400
300
200
100
0
0,00
0,05
0,10
0,15
0,20
1/ x² (cm⁻²)

PROCESS AND APPARATUS FOR DETECTING SAMPLE MOLECULES IN A CARRIER GAS

The present invention relates to a process for detecting sample molecules in a carrier gas, wherein a divergent stream of carrier gas is generated by means of expansion of the carrier gas through a nozzle into a vacuum, the sample molecules are ionized selectively to form sample molecule ions in an ionization zone of the stream of carrier gas by absorption of photons and the sample molecule ions are drawn by an electrical pulling field into a mass spectrometer and detected in the mass spectrometer.

Processes of this type are known from the literature, for example, under the name "resonance enhanced multiphoton ionization" (REMPI) although this designation relates, in a narrower sense, only to the process used for the selective photoionization.

It is possible to measure several types of sample molecules in concentrations in the ppb range with this technique but these sensitivities are not adequate, for example, for the continuous measurement of dioxin. For an on-line measurement of, for example, H7CDD in the crude gas, an increase in the sensitivity by about three orders of magnitude is required, on the presumption that the ionization yield of H7CDD is comparable to that of other chlorinated aromatic compounds.

The object underlying the present invention was therefore to improve a process of the type specified at the outset such that the sensitivity of the process is distinctly increased without forfeiting selectivity.

This object is accomplished in accordance with the invention, in a process having the features of the preamble to claim 1, in that a continuum zone of the stream of carrier gas, in which the temperature of the carrier gas decreases with increasing distance (x) from an exit aperture of the nozzle, a molecular beam zone of the stream of carrier gas, in which the temperature of the carrier gas does not essentially decrease any further with increasing distance (x) from the exit aperture of the nozzle, and a boundary between the continuum zone and the molecular beam zone are determined and that the sample molecules are ionized in an ionization zone near to the boundary between the continuum zone and the molecular beam zone.

The inventive idea is based on the knowledge that the stream of carrier gas will not be continuously cooled more and more during the expansion into the vacuum but reaches a minimum temperature at a certain distance from the exit aperture of the nozzle.

The drop in temperature is correlated to an increase in the Mach number which specifies the ratio of the local speed of flow to the local sonic speed. The maximum or terminal Mach number is reached at the same distance from the exit aperture of the nozzle as the minimum temperature.

The temperature of the carrier gas is determined in the customary manner from the width of the velocity distribution of the carrier gas particles. Additional temperatures can be determined for polyatomic carrier gas particles, apart from this "translational temperature", from the occupation of the rotational or vibrational level and these temperatures can, in certain circumstances, deviate from the translational temperature and from one another. All these temperatures do, however, reach their minimum at essentially the same distance from the exit aperture of the nozzle.

Different temperatures can be defined not only for the carrier gas particles but also for the sample molecules and these temperatures can differ from one another and from those of the carrier gas. These temperatures of the sample molecules also do not essentially decrease any further from essentially the same distance from the exit aperture of the nozzle as the temperatures of the carrier gas.

In the following, a distinction will therefore no longer be made between the differently defined temperatures of the carrier gas and the sample molecules, respectively, but the term "the temperature" will be used as a collective term for the translational, rotational and vibrational temperatures.

The region of the stream of carrier gas between the exit aperture of the nozzle and the distance, at which the minimum temperature is reached, is designated as continuum zone. The region of the stream of carrier gas following the continuum zone at greater distances from the exit aperture of the nozzle is designated as molecular beam zone.

The selectivity of the photoionization increases, like the sensitivity, with a decreasing temperature of the sample molecules in the ionization zone of the stream of carrier gas and is therefore greater in the molecular beam zone in comparison with the continuum zone but cannot be improved further by displacing the ionization zone within the molecular beam zone.

The sensitivity of the process for detecting sample molecules is essentially proportional to the density of the sample molecules and, due to the divergence of the stream of carrier gas with increasing distance (x) from the exit aperture of the nozzle, decreases essentially reciprocally to the square of the distance x.

According to the inventive idea, the best possible selectivity and sensitivity of the detection process can be attained when the position (dependent, for example, on the diameter of the nozzle and on the pressure prevailing over the nozzle) and extension of the continuum zone and of the molecular beam zone as well as the position of the boundary between these zones is determined for the stream of carrier gas and the sample molecules are ionized close to this boundary.

This means that as strong a cooling down of the sample molecules as possible, which is required for a selective photoionization, is maintained without the density of the carrier gas and, therefore, of the sample molecules thereby decreasing more than is unavoidable due to the divergence of the stream of carrier gas.

In an advantageous development of the inventive process, a distance ($x_T$) of the boundary between the continuum zone and the molecular beam zone from the exit aperture of the nozzle is determined and the sample molecules are ionized at a distance (x) from the exit aperture of the nozzle of between approximately 0.5 $x_T$ and approximately 3 $x_T$. The distance $x_T$ can hereby be ascertained experimentally or theoretically on the basis of dynamic gas considerations.

It proves to be particularly advantageous when the sample molecules are ionized at a distance (x) from the exit aperture of the nozzle of between approximately 0.8 $x_T$ and approximately 2 $x_T$, preferably between approximately 0.9 $x_T$ and approximately 1.5 $x_T$.

The distance ($x_T$) of the boundary between the continuum zone and the molecular beam zone of the stream of carrier gas from the exit aperture of the nozzle increases with the diameter of the exit aperture and with the pressure prevailing over the nozzle. However, with increasing pressure and diameter of the exit aperture, the mass flow through the nozzle also increases and so it becomes increasingly more difficult to maintain an adequate vacuum. It is, therefore, of advantage to select the pressure over the nozzle and the diameter of the exit aperture such that the boundary between the continuum zone and the molecular beam zone of the stream of carrier gas and, therefore, the ionization zone is arranged at an average distance from the exit aperture of the nozzle of less than approximately 7 cm, preferably less than approximately 3 cm.

It is, furthermore, advantageous for maintaining as good a vacuum as possible when a pulsed stream of carrier gas is generated by means of a pulsed nozzle.

It is particularly favorable when a pulsed stream of carrier gas is generated with a pulse-pause ratio of less than approximately 0.15, preferably less than approximately 0.05.

In addition, it is of advantage when the electrical pulling field is generated by a proboscidean or snout-shaped pulling electrode, the external diameter of which is smaller than double the distance between the exit aperture of the nozzle and the ionization zone. Such a snout-shaped pulling electrode allows an inlet aperture of the pulling electrode to be arranged in the direct vicinity of the ionization zone even when the distance between the ionization zone and the exit aperture of the nozzle is small and so the sample molecule ions are drawn into the mass spectrometer along the axis thereof and the distances to be covered by the sample molecule ions between the place of ionization and the inlet aperture of the pulling electrode can be kept short in order to avoid as far as possible interferences caused by interaction with carrier gas particles or other sample molecules which can lead to scattering, charge transfer or fragmentation.

In order to avoid any distortion of the electrical pulling field by the nozzle, even with a small distance between the nozzle and a pulling electrode generating the electrical pulling field, it is of advantage when the electrical pulling field is shielded by an electrostatic shield arranged between the nozzle and the pulling electrode.

The shielding effect is best effective when the electrostatic shield encloses the pulling electrode.

The electrostatic shield advantageously encloses the pulling electrode rotationally symmetric to its longitudinal axis. In this case, an electrical pulling field can be generated which is rotationally symmetric to the longitudinal axis of the pulling electrode and accelerates all the generated sample molecule ions towards this longitudinal axis.

In addition, it is favorable when the electrostatic shield allows carrier gas particles to pass through to a great extent by being designed, for example, as a grating. In this way, the risk is diminished of neutral carrier gas particles passing in an undesired manner into the region between the stream of carrier gas and the pulling electrode or into the pulling electrode following reflection on the electrostatic shield.

In order to protect the entire electrical pulling field from any distortion caused by the nozzle, it is favorable when the electrostatic shield encloses, in addition, a counterelectrode generating the pulling field together with the pulling electrode.

Any undesired scattering of carrier gas particles into the region between the stream of carrier gas and the pulling electrode or into the pulling electrode can, in addition, be advantageously prevented by the stream of carrier gas entering the electrostatic shield through an inlet aperture and exiting from the electrostatic shield through an exit aperture.

It is of advantage when a pulling field which is essentially antisymmetric to a plane extending through the axis of the stream of carrier gas is generated by means of a counterelectrode essentially symmetric to the pulling electrode.

It is favorable when the pulling field is generated by means of a counterelectrode with an inlet aperture and electrons released during the ionization of the sample molecules are drawn by the pulling field through the inlet aperture into the counterelectrode. This means that those electrons, which are accelerated towards the counterelectrode, are prevented to a large extent from knocking atoms or ions out of the surface of the counterelectrode which themselves pass into the mass spectrometer, ionize carrier gas particles and could, therefore, interfere with the detection of the sample molecules.

Furthermore, it is advantageous when the electrical pulling field guides the sample molecule ions from the ionization zone on paths which intersect in the interior of the pulling electrode essentially at a common point of intersection on the longitudinal axis of the pulling electrode. This ensures that the paths of the sample molecule ions all extend through an area which is, spatially, narrowly limited and from which they, if necessary by means of a suitable ion optical means, can be conducted into the mass spectrometer.

It is of advantage for an optimum ion-optical imaging when the ionization of the sample molecules takes place in an area on or near the axis of the mass spectrometer.

It is particularly advantageous when particles, the paths of which do not extend through the point of intersection, are kept away from the mass spectrometer by means of an apertured partition. In this way, any deterioration in the vacuum in the mass spectrometer by neutral carrier gas particles or sample molecules diffusing into it is prevented and interferences caused by sample molecule ions deviating from their prescribed path due to scattering are avoided.

If it is advantageously provided for a field forming electrode at ground potential and coaxial to the pulling electrode to increase the curvature of equipotential surfaces of the pulling field between the ionization zone and the pulling electrode, it is possible due to this measure for sample molecule ions from the edge region of the ionization zone extending in a direction at right angles to the longitudinal axis of the pulling electrode also to be accelerated towards the inlet aperture of the pulling electrode.

The divergence of the ion beam entering the mass spectrometer is reduced further when the sample molecule ions drawn into the mass spectrometer are directed by an ion optical means onto paths essentially parallel to the axis of the mass spectrometer.

Such a parallelization of the paths of the sample molecule ions is possible in a particularly simple manner when the electrical pulling field guides the sample molecule ions from the ionization zone onto paths which intersect in the interior of the pulling electrode essentially at a common point of intersection on the longitudinal axis of the pulling electrode, and the ion optical means is arranged between the pulling electrode and the mass spectrometer such that its focal point coincides with the point of intersection of the paths of the sample molecule ions since an ion optical means directs ions moving through the focal point of the ion optical means onto paths parallel to its ion-optical axis.

No details have so far been given concerning the type of mass spectrometer used for the detection of the ion masses.

In principle, it is possible to use any optional mass spectrometer for analyzing the ion masses.

It is, however, particularly favorable for a reflectron to be used as mass spectrometer. Such a reflectron is a time-of-flight mass spectrometer, in which the ions entering the spectrometer first pass through a field-free area at a constant speed, are thereupon decelerated in a retarding field until their direction of movement is turned back at a point of reversal and the ions are again accelerated so that they leave the retarding field at their original speed but in the reverse direction, and the ions are finally detected by a detector once they have again passed through the field-free area at a constant speed.

The principle of the reflectron offers the advantage that ions having the same mass but different speeds at entry into the reflectron require essentially the same flight time from an inlet aperture of the mass spectrometer up to the detector. Those ions which have a higher entry speed do require a shorter time to pass through the field-free areas but, in return, remain for a longer time in the retarding field since they are decelerated with the same time lag as the ions, which are slower at the beginning, but from a higher entry speed.

When the distance to be covered in the field-free area is suitably coordinated with the strength of the retarding field, it is possible for the entire flight time for a region of the entry speed of the ions to be only slightly dependent on this speed. This means that a high mass resolution can also be attained even when the ionization zone has a large extension so that the sample molecule ions absorb different energies from the pulling field. Thus, the ionization zone can be increased in size along the field lines of the pulling field, as a result of which the number of ionized sample molecules and, therefore, the sensitivity of the process for detecting the sample molecules are increased.

In a preferred embodiment of the inventive process, it is provided for a nozzle made from electrically non-conducting material to be used. Such a nozzle distorts the electrical pulling field to a lesser degree than a nozzle made from electrically conducting material.

Furthermore, the inventive object is also accomplished by an apparatus for detecting sample molecules in a carrier gas, comprising a nozzle for generating a divergent stream of carrier gas by means of expansion of the carrier gas into a vacuum, a means for the selective ionization of the sample molecules to form sample molecule ions in an ionization zone of the stream of carrier gas by means of absorption of photons, a mass spectrometer and a means for generating an electrical pulling field drawing the sample molecule ions into the mass spectrometer with a pulling electrode, in that the ionization zone is arranged near to a boundary determined for the stream of carrier gas between a continuum zone determined for the stream of carrier gas, in which the temperature of the carrier gas decreases with increasing distance (x) from an exit opening of the nozzle, and a molecular beam zone determined for the stream of carrier gas, in which the temperature of the carrier gas essentially does not decrease any further with increasing distance (x) from the exit opening of the nozzle.

The inventive apparatus offers the advantage that the ionization of the sample molecules takes place in the vicinity of the boundary between the continuum zone and the molecular beam zone of the stream of carrier gas where as strong a cooling of the carrier gas as possible, which is required for a selective photoionization, is obtained without the density of the carrier gas thereby decreasing more than is unavoidable due to the divergence of the stream of carrier gas.

Advantageous developments of the inventive apparatus are the subject matter of claims 24 to 37 and 40 to 47, the advantages of which have been explained in the foregoing in conjunction with claims 2 to 22.

A development of the inventive apparatus according to claim 38 offers the advantage that particles knocked out of an outer surface of the pulling electrode by ions and thereby ionized are not accelerated towards the ionization zone but guided past this zone. This also decreases interference effects which can occur when particles knocked out of the pulling electrode ionize carrier gas particles or fragment carrier gas particles or sample molecules.

A development of the inventive apparatus according to claim 39 has the advantage that particles possibly knocked out of an outer surface of the counterelectrode by electrons released during the ionization of the sample molecules and thereby ionized are not accelerated towards the pulling electrode and the ionization zone arranged between the counterelectrode and the pulling electrode but are guided past them. This reduces the interference effects which can occur when particles originating from the counterelectrode pass into the mass spectrometer, ionize carrier gas particles or fragment sample molecules.

Additional features and advantages of the invention are the subject matter of the following description as well as the drawings showing one embodiment.

Figure 1:
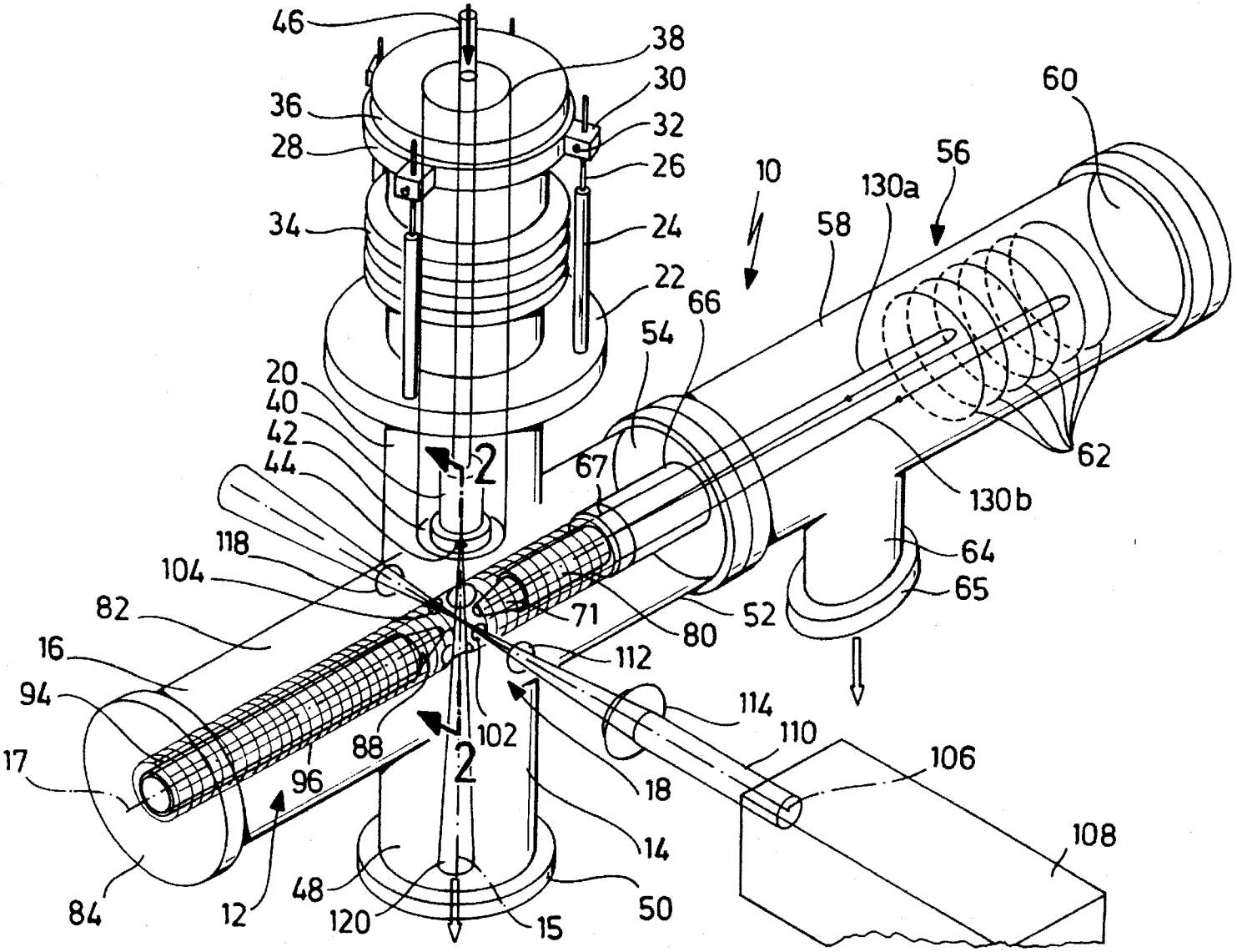
FIG. 1 shows a partially cutaway, perspective illustration of an inventive apparatus for detecting sample molecules in a carrier gas.

An apparatus for detecting sample molecules in a carrier gas which is illustrated in FIG. 1 and designated as a whole as 10 comprises a vacuum chamber 12 in the shape of a pipe or tube cross. This tube cross comprises a first tube 14 with a, for example, vertically aligned axis 15 and a second tube 16 with an axis 17 aligned at right angles to the axis 15, with the axis 15 of the first tube 14 and the axis 17 of the second tube 16 intersecting at a point such that a central region 18 belonging to the interior of both tubes 14 and 16 is formed.

An upper section 20 of the first tube 14 extending upwards from the central region 18 is closed by a cylindrical cover 22 which is coaxial to the first tube 14 and the diameter of which exceeds that of the first tube 14.

At its end face remote from the first tube 14, the cover 22 bears, for example, four cylindrical support rods 24, the axes of which are aligned parallel to the axis 15 of the first tube 14 and which are arranged near to the circumference of the cover 22 at an equal distance from the axis 15 of the first tube 14 and at a respective angular distance of 90° in relation to this axis. Each of the support rods 24 bears a guide rod 26 which is coaxial thereto, the diameter of which is smaller than that of the support rods 24 and each of which penetrates a through bore in a clamping block 30 arranged on an outer wall of a clamping ring 28 coaxial to the first tube 14.

The clamping blocks 30 can slide on the guide rods 26 upwards or downwards and each be fixed in their vertical position by a setscrew 32. Due to the guidance of the clamping blocks 30 on the guide bars 26 it is ensured that the clamping blocks 30 are always located at the same height as one another and the axis of the clamping ring 28 remains vertically aligned.

A hollow-cylindrical bellows 34 coaxial to the first tube 14 is secured in position with an open, upper end so as to be gastight against an underside of the clamping ring 28 and with an open, lower end so as to be gas-tight against the upper side of the cover 22. The wall of the bellows 34 consists at least partially of an elastic material laid in folds so that by drawing the folds apart or pressing them together the height of the bellows 34 can be altered as a function of the position of the clamping ring 28.

Furthermore, the clamping ring 28 bears a cylindrical cover plate 36 which is coaxial to and has a slightly smaller diameter than this ring and closes an upper end of a support tube 38. This support tube is coaxial to and has a smaller diameter than the cover plate 36 and extends from an underside of the cover plate 36 downwards through the clamping ring 28, the bellows 34, a through opening in the cover 22 and the upper section 20 of the first tube 14 and ends in the central region 18 near to its upper edge.

At its lower end, the support tube 38 supports a valve nozzle 40 arranged in the interior thereof. A cylindrical outlet plate 42 forming a base of the valve nozzle 40 is flush with the lower end of the support tube 38 and closes it.

Furthermore, the outlet plate has a central outlet aperture 44 of the valve nozzle 40 having a diameter of, for example, 0.5 mm.

The valve nozzle 40 is connected by means of control lines (not illustrated) to a control device (not illustrated) which can open and close the valve nozzle 40 in an adjustable cycle.

An inlet aperture of the valve nozzle 40 is connected to a carrier gas reservoir (not illustrated) via a tubular supply line 46 coaxial to the support tube 38.

A lower section 48 of the first tube 14 extending downwards from the central region 18 is connected at a lower end 50 to a suction port of a first vacuum pump (not illustrated).

A right-hand section 52 of the second tube 16 extending to the right from the central region 18 is closed at a right-hand end by an end wall 54 of a reflectron mass spectrometer (reflectron) 56 flange connected to the second tube 16.

The reflectron 56 comprises a vacuum tube 58 which is coaxial to and has the same diameter as the second tube 16 and is closed at an end remote from the end wall 54 by an end wall 60.

A plurality of ring-shaped retarding electrodes 62 which are concentric to and have a slightly smaller diameter than the vacuum tube 58 are arranged in the half of the vacuum tube 58 facing the end wall 60.

In the region of the half of the vacuum tube 58 facing the end wall 54, a pump tube 64, the axis of which is vertically aligned, opens into the vacuum tube 58. At a lower end 65, the pump tube 64 is connected to a suction port of a second vacuum pump (not illustrated).

The side of the end wall 54 facing the second tube 16 bears a detector tube 66 which is concentric to and has a smaller diameter than the second tube 16. The end of the detector tube pointing into the vacuum chamber 12 is closed and holds a ring-shaped ion detector 67 arranged within the detector tube 66 which opens into the vacuum tube 58 through the end wall 54 at its end facing the reflectron 56.

Figure 2:
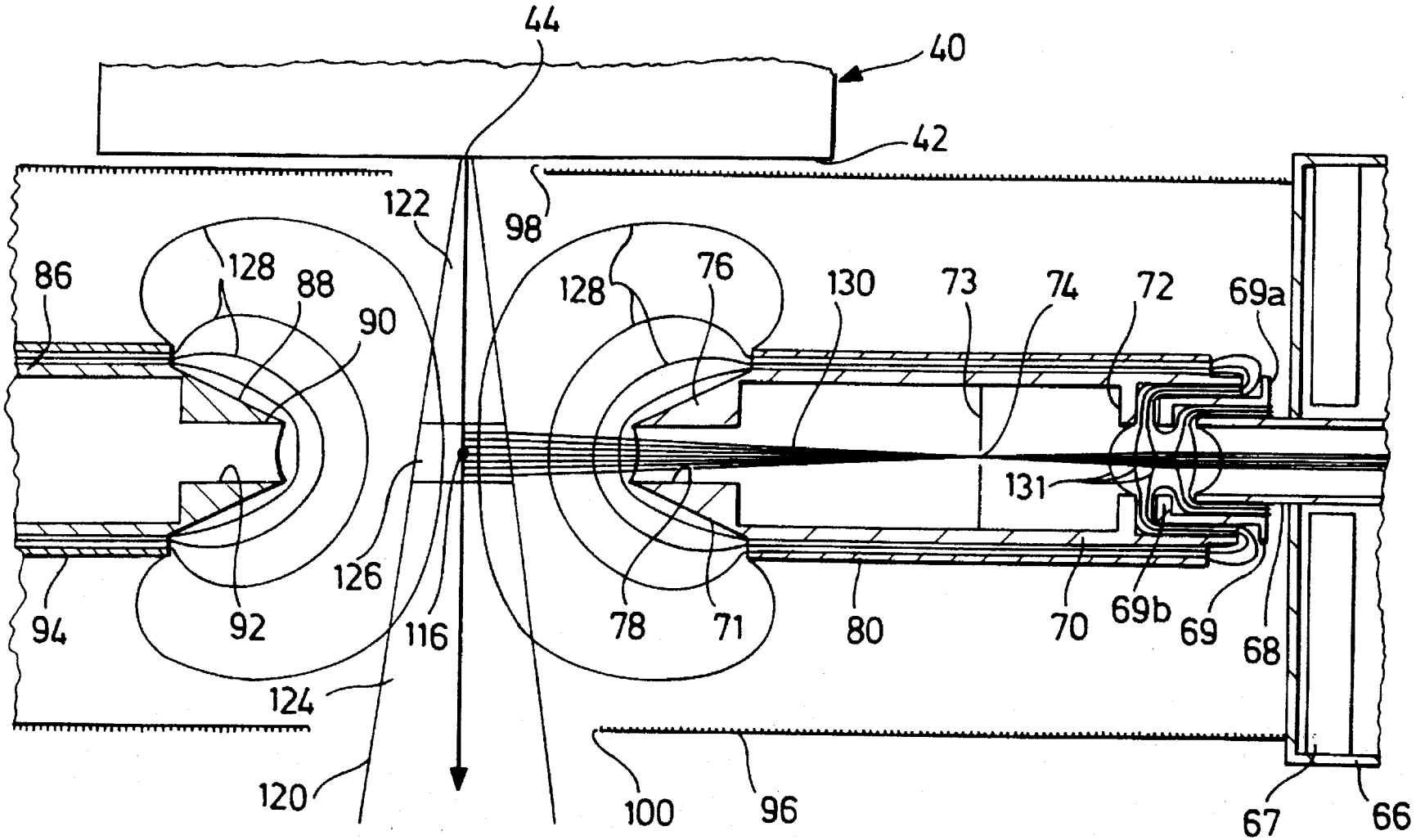
FIG. 2 is a longitudinal section through the inventive apparatus from FIG. 1 along line 2—2, with equipotential surfaces of the electrical pulling field illustrated.

The closed end of the detector tube 66 and the ring aperture of the ring-shaped ion detector 67 are, as illustrated in FIG. 2, penetrated by an entry tube 68 which is coaxial to the detector tube 66 and makes it possible for an ion beam to pass into the detector tube 66 from the vacuum chamber 12.

An end of the entry tube 68 arranged in the vacuum chamber 12 is encircled by an ion einzel lens 69 which is coaxial thereto and has the shape of a hollow cylinder which is open at both ends and bears at the end facing the detector tube 66 a collar **69*a* projecting outwards and at the end remote from the detector tube 66 a collar 69*b*** projecting inwards.

The ion-optical axis of the ion einzel lens 69 coincides with the axis of the entry tube 68.

The ion einzel lens 69 is encircled by an open end of a hollow-cylindrical section 70 of a snout-shaped pulling electrode 71, this section being coaxial to the entry tube 68.

The hollow-cylindrical section 70 has an external diameter of, for example, 1.3 cm and bears a collar 72 projecting inwards, the internal diameter of which corresponds to that of the collar **69*b* and to the internal diameter of the entry tube 68 and the distance of which from the collar 69*b* corresponds to the distance of the end of the entry tube 68 arranged in the vacuum chamber 12 from the collar 69*b*. This ensures that the electrical field of the ion einzel lens 69 is essentially antisymmetric to a plane aligned vertically to the ion-optical axis and intersecting the ring 69*b***.

Furthermore, an apertured partition 73 coaxial to the hollow-cylindrical section 70 is arranged within this section and its circular partition aperture includes a focal point 74 of the ion einzel lens 69.

The end of the hollow-cylindrical section 70 remote from the ion einzel lens 69 is closed by a frustum-shaped tip 76 of the snout-shaped pulling electrode 71 which is coaxial to this section. The tip has a central inlet bore 78 for the passage of an ion beam, the diameter of which corresponds to the diameter of the end face of the frustum-shaped tip 76 remote from the hollow-cylindrical section 70.

In addition, the hollow-cylindrical section 70 of the pulling electrode 71 is enclosed by a hollow-cylindrical field-forming electrode 80 having an internal diameter slightly exceeding the external diameter of the hollow-cylindrical section 70.

As illustrated in FIG. 1, a left-hand section 82 of the second tube 16 extending to the left from the central region 18 of the vacuum chamber 12 is closed at a left-hand end by a cylindrical cover 84.

The inner side of the cover 84 facing the vacuum chamber 12 bears a hollow-cylindrical section 86 of a counterelectrode 88 which is coaxial to the second tube 16 and, therefore, also to the pulling electrode 71 and has the same diameter as the hollow-cylindrical section 70 of the pulling electrode 71, as illustrated in FIG. 2.

At an end remote from the cover 84, the hollow-cylindrical section 86 is closed by a frustum-shaped tip 90 of the counterelectrode 88. The frustum-shaped tip 90 is identical in its construction to the frustum-shaped tip 76 of the pulling electrode 71 and therefore also has a central bore 92, the diameter of which corresponds to the diameter of the end face of the frustum-shaped tip 90 remote from the hollow-cylindrical section 86.

The hollow-cylindrical section 86 of the counterelectrode 88 is also enclosed by a hollow-cylindrical field-forming electrode 94 which is concentric thereto and the diameter of which corresponds to the field-forming electrode 80.

The frustum-shaped tip 76 of the pulling electrode 71 and the frustum-shaped tip 90 of the counterelectrode 88 are arranged symmetrically to one another in relation to the axis 15 of the first tube 14.

The pulling electrode 71, the counterelectrode 88 and the field-forming electrodes 80 and 94 are enclosed by a hollow-cylindrical electrostatic shield 96 which is coaxial to them, is supported on the cover 84 and on the base of the entry tube 66 and the casing of which is formed by a grating made from a conductive material.

Within the central region 18, the electrostatic shield 96 has an essentially circular inlet aperture 98 for a stream of carrier gas, which faces the valve nozzle 40 and is concentric to the axis 15 of the first pipe 14, an essentially circular exit aperture 100 for a stream of carrier gas, which faces the lower section 48 of the first tube 14 and is likewise concentric to the axis 15 of the first tube 14, an essentially circular inlet opening 102 for a laser beam, which is concentric to an axis 106 aligned at right angles to both the axis 15 of the first tube 14 and the axis 17 of the second tube 16, as well as an essentially circular exit aperture 104 for a laser beam which is located opposite to the inlet opening and is likewise concentric to the axis 106.

The axis 106 forms the optical axis of a pulsed laser 108 which is arranged outside the vacuum chamber 12 and the laser beam 110 of which passes through a window 112 in a wall of the vacuum chamber 12 once it has been focused by a lens 114, which is arranged between the laser 108 and the window 112 on the optical axis 106, onto its focal point 116 which is arranged at the point of intersection of the axes 15, 17 and 106. After passing through the focal point 116, the laser beam 110 which is now divergent exits the vacuum chamber 12 again through a second window 118 located opposite the first window 112.

The pulsed laser 108 can be controlled via the control device (not illustrated) of the valve nozzle 40 and synchronized with the valve nozzle 40.

Furthermore, the laser 108 can be tuned in a certain wavelength range, for example from 210 to 400 nm, and supplies a pulse energy of, for example, 1 to 3 mJ at a power density of, typically, approximately $10^6$ W/cm$^2$.

The inventive process is carried out as follows by means of the inventive apparatus for detecting sample molecules in a carrier gas:

First of all, the vacuum chamber 12 is evacuated by means of the first vacuum pump and the vacuum tube 58 by means of the second vacuum pump to a pressure of, typically, $10^{-4}$ Pa ($10^{-6}$ mbar) each.

A carrier gas (for example, argon) loaded with the sample molecules to be detected (for example, 2,5-dichlorotoluene) is made available in the carrier gas reservoir (not illustrated). The carrier gas then fills the tubular supply line 46.

The valve nozzle 40 is now opened at the same time by the control device (not illustrated). Thereupon, the carrier gas subject to the pressure $P_0$ (for example, $1.013\times10^5$ Pa (1 atm)) in the supply line 46 flows out through the exit aperture 44 of the valve nozzle 40 with the diameter D (for example, 0.5 mm) into the vacuum chamber 12, whereby a stream of carrier gas 120 coaxial to the axis 15 of the first tube 14 and widening in the shape of a frustum is generated in the vacuum chamber 12.

This stream of carrier gas 120 comprises a continuum zone 122, which extends from the exit aperture 44 as far as a distance $x_T$ from the exit opening 44, as well as a molecular beam zone 124 following the continuum zone 122 at greater distances x from the exit aperture 44.

The continuum zone 122 is characterized in that within this zone the temperature of the stream of carrier gas and, therefore, of the sample molecules decreases with increasing distance x. This cooling of the sample molecules is desired for the application of the resonance enhanced multiphoton ionization since the sample molecules will not be resonantly excited with adequate selectivity until temperatures of around 1 K for the translation and a few K for the rotation are reached.

However, the minimum temperature not only of the carrier gas particles but also of the sample molecules is reached after a predetermined distance $x_T$. In the molecular beam zone 124 which is characterized by a constant temperature it is only the density of the stream of carrier gas 120 which alters with increasing distance x from the exit aperture 44, namely this decreases reciprocally to the square of the distance x due to the cone-shaped divergence of the stream of carrier gas 120.

Such a decrease in the density of the carrier gas and, therefore, of the sample molecules is not, however, desired since the sensitivity of the detection is essentially proportional to the density of the molecules to be detected.

From the distance $x_T$ onwards, the stream of carrier gas 120 consequently becomes increasingly unsuitable for analytical purposes.

Optimum conditions do, however, prevail at the distance $x_T$ and so the ionization of the sample molecule is favorably carried out in a zone around this distance.

For this purpose, the clamping ring 28 and, with it, the cover plate 36, the support tube 38 and, finally, the valve nozzle 40 are displaced in vertical direction until the focal point 116 of the laser beam 110 has approximately the distance $x_T$ from the exit aperture 44 of the valve nozzle 40 or, expressed differently, an ionization zone 126 surrounding the focal point 116 will be positioned near to the boundary between the continuum zone 122 and the molecular beam zone 124 of the stream of carrier gas 120.

The nozzle 40 can be displaced downwards to such an extent until it nearly touches the electrostatic shield 96. If this has an external diameter of, for example 4 cm, the distance between the exit aperture 44 of the nozzle 40 and the focal point 116 can be reduced to almost 2 cm.

The optimum distance $x_T$ can be either determined experimentally by displacing the valve nozzle 40 and observing the alterations in the ion signal generated by the reflectron 56 or estimated by way of the following theoretical, dynamic gas considerations:

The maximum, terminal Mach number $M_T$ which can be reached during the expansion through the nozzle 40 depends, according to Anderson and Fenn, for monoatomic gases such as argon, as follows, on the nozzle diameter D (in cm) and the pressure $P_0$ over the nozzle (in arm) (cf., for example, S. R. Goates and C. H. Lin, Applied Spectroscopy Reviews 25 (1989), pages 81 to 126):

$$M_T=133\ (P_oD)^{0.4} \qquad \text{(I)}$$

The Mach number M is the ratio of local flow speed to local sonic speed. It is linked to the distance x from the exit aperture 44 of the nozzle 40 via the equation $$M=A\ (x/D)^{\gamma-}, \qquad \text{(II)}$$

with the adiabatic exponent $\gamma=5/3$ and the proportionality factor A=3.26 for the case of monoatomic carrier gases, such as, for example, argon or helium.

The distance $x_T$, at which the terminal Mach number $M_T$ is reached, corresponds to the distance, after which no further cooling occurs. It is obtained by replacing the Mach number M in equation (II) by the terminal Mach number $M_T$ and substituting the right side of the equation (I) for $M_T$. This results in the equation:

$$x_T=260.6\ p_0^{0.6}D^{1.6},$$

wherein $P_0$ is to be specified in atm and D in cm and $x_T$ results in cm. For a pressure prevailing over the nozzle of $1.013\times10^5$ Pa (1 atm) and a nozzle diameter D of 0.05 cm, an optimum distance $x_T$ of approximately 2.2 cm results for a monoatomic carrier gas, such as, for example, argon or helium.

Such a small distance between the ionization zone 126 and the exit aperture 44 cannot be realized with conventional mass spectrometers since the plane ion grids used for drawing off the ions already have, on their own, a lateral extension of at least 3 cm. If a skimmer is attached, in addition, to improve the vacuum in the vacuum chamber 12, this requires an additional distance between the ionization zone 126 and the exit aperture 44.

On the other hand, in the embodiment described in the above of an inventive apparatus 10 for detecting sample molecules in a carrier gas, the distance between the ionization zone 126 and the exit aperture 44 is limited downwards essentially only by the radius of the hollow-cylindrical electrostatic shield 96 which can easily be reduced to 2 cm or less. This means that it is possible to arrange the ionization zone 126 at an average distance x from the exit aperture 44 of the nozzle 40 which corresponds or at least comes close to the optimum distance $x_T$.

Following a nozzle opening time of, for example, 100 μs for the carrier gas argon, the stream of carrier gas 120 has formed a stationary flow. A laser pulse of the laser 108 is now triggered simultaneously by the control device (not illustrated and a timer (not illustrated) is reset and started.

The ionization of the sample molecules taken along in the stream of carrier gas 120 takes place in the ionization zone 126 surrounding the focal point 116, onto which the laser beam 110 is focused, by way of resonance enhanced multiphoton ionization (REMPI), whereby a sample molecule is converted each time by means of absorption of one or more photons with a suitable energy into an excited state, from which the sample molecule is then ionized by means of absorption of an additional photon (or several additional photons) to form a sample molecule ion.

The photoionization can also take place by means of an unfocused laser beam, whereby an increase in the size of the ionization zone 126 and, therefore, in the sensitivity of the detection process is achieved. Furthermore, the selectivity of detection is increased by a decrease in the laser power density in the ionization zone 126. Attention should, however, be paid that the power density does not become too small to ensure an adequate ionization probability of the sample molecules.

Since the sample molecules in the ionization zone 126 are cooled to a very considerable extent, namely to temperatures around 1 K for the translation and a few K for the rotation, the photon energy required for the transition into the excited molecule state is sharply defined and so the probability for the transition into the excited state and, therefore, the probability for the ionization of a sample molecule decreases to a very considerable extent as soon as the energy required for the transition deviates from that of the photons radiated in or from a small integral multiple thereof.

Since the transition energy is specific to the molecule, different isomers which have the same mass can, for example, be selectively ionized due to an alteration in the wavelength of the tunable laser 108.

The resulting sample molecule ions are drawn by an electrical pulling field out of the stream of carrier gas 120 essentially at right angles to the axis thereof and into the interior of the pulling electrode 71 through the inlet bore 78. FIG. 2 illustrates several equipotential surfaces of the electrical pulling field, designated as 128, as well as several ion paths 130 intersecting the equipotential surfaces 128.

An electrical pulling field which is rotationally symmetric in relation to the common longitudinal axis of the pulling electrode 71 and the counterelectrode 88 and antisymmetric in relation to a plane extending at right angles to this longitudinal axis through the axis of the stream of carrier gas 120 is generated by the pulling electrode 71 and the counterelectrode 88 having electrical potentials of equal value but different polarity signs.

In the following, it is assumed that positive sample molecule ions result during the photoionization. In this case, the pulling electrode 71 must have a negative electrical potential and the counterelectrode 88 a positive electrical potential.

Electrons are released during the ionization of the sample molecules. The majority of these electrons is drawn by the electrical pulling field through the central bore 92 into the interior of the counterelectrode 88 so that they do not knock any particles out of the outer surfaces of the counterelectrode 88.

Since the counterelectrode 88 has no outer surfaces, the surface perpendiculars of which are directed towards the pulling electrode 71, particles, which are knocked out of the outer surface of the frustum-shaped tip 90 by electrons striking this surface and are thereby ionized, do not pass into the ionization zone 126 or to the pulling electrode 71 but are accelerated by the electrical pulling field essentially towards the electrostatic shield 96 so that these particles originating from the counterelectrode 88 do not reach either the reflectron 56 or the stream of carrier gas 120 where they could be an interference due to ionization of carrier gas particles or fragmentation of carrier gas particles or sample molecules.

Since the pulling electrode 71 has no outer surfaces, the surface perpendiculars of which are directed towards the ionization zone 126, particles, which are knocked out of the outer surface of the frustum-shaped tip 76 by ions striking this surface and are thereby ionized, do not pass into the ionization zone 126 but are accelerated by the electrical pulling field essentially towards the electrostatic shield 96 so that these particles originating from the pulling electrode 71 do not reach the stream of carrier gas 120 where they could be an interference due to ionization of carrier gas particles or fragmentation of carrier gas particles or sample molecules.

As a result of the field-forming electrodes 80 and 94 which are at ground potential, the equipotential surfaces 128 between the pulling electrode and the field-forming electrode 80 and between the counterelectrode 88 and the field-forming electrode 94 are pressed together and can diverge only in the region of the frustum-shaped tips 76 and 90, respectively. This results in a strong curvature of the equipotential surfaces 128 in the region of the common longitudinal axis of the pulling electrode 71 and the counterelectrode 88, which has the advantage that the ion paths 130 of sample molecule ions from the edge region of the ionization zone 126 are inclined to a considerable extent towards this longitudinal axis so that these sample molecule ions can also pass through the inlet bore 78 into the interior of the pulling electrode.

As a result of the rotational symmetry of the electrical pulling field, the ion paths 130 intersect at a common point of intersection on the longitudinal axis of the pulling electrode 71 in the interior thereof. The electrostatic shield 96 prevents the nozzle 40 from interfering with the rotational symmetry of the pulling field.

Figure 3:
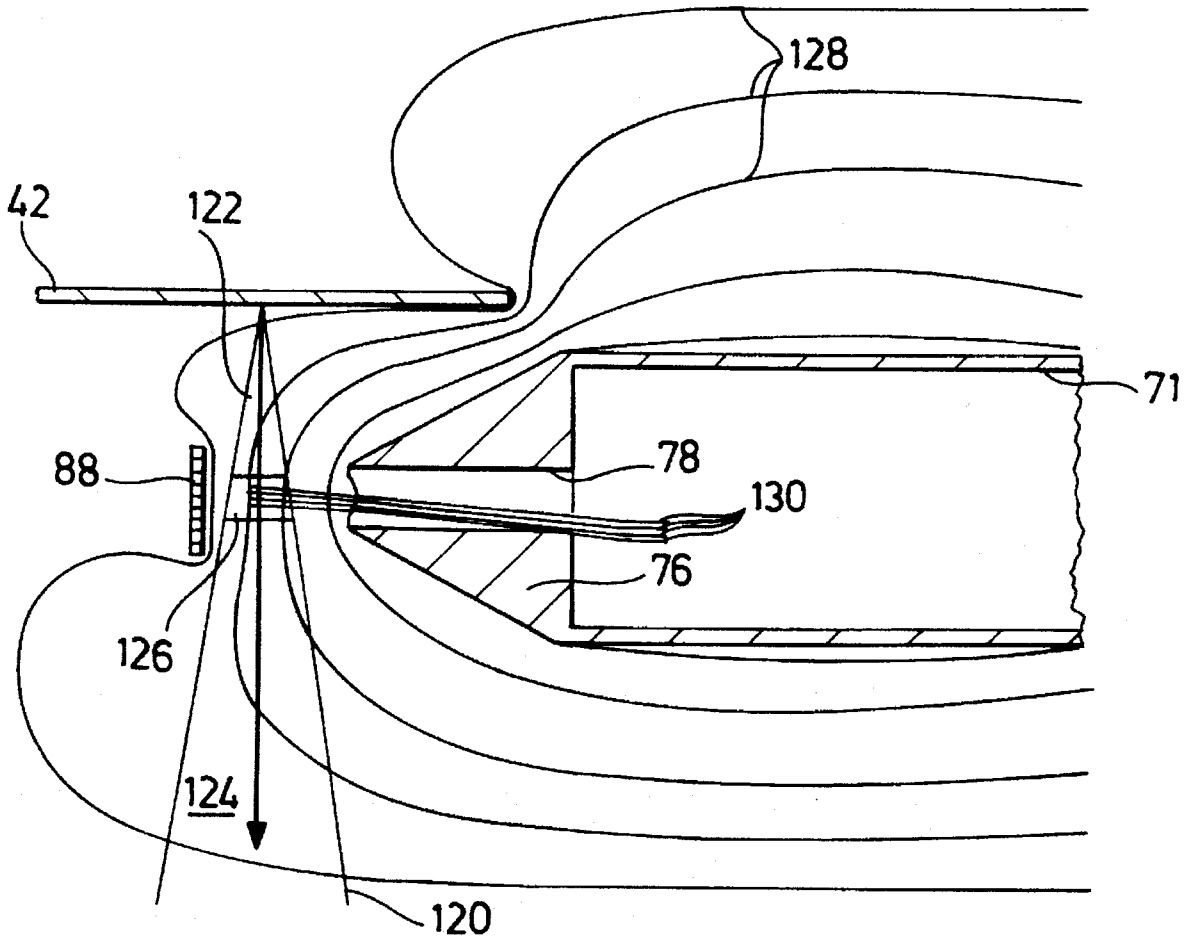
FIG. 3 is an illustration corresponding to FIG. 2 of one embodiment of the inventive apparatus with a counterelectrode not symmetric to the pulling electrode as well as without an electrostatic shield and field-forming electrode.

The advantage of using an electrostatic shield 96, a counterelectrode 88 symmetric to the pulling electrode 71 and field-forming electrodes 80 and 94 becomes particularly clear from a comparison of FIG. 2 with FIG. 3 which shows a longitudinal section through a further embodiment of the inventive apparatus 10. In this embodiment, the electrostatic shield 96 and the field-forming electrodes 80 and 94 have been omitted and a counterelectrode 88 in the shape of a circular disk not symmetric to the pulling electrode 71 has been used. As for the rest, it corresponds to the embodiment of the inventive apparatus 10 as described in the above.

It can be clearly seen that the equipotential lines 128 do not extend rotationally symmetrically in FIG. 3. Consequently, the ion paths 130 are also not arranged symmetrically around the longitudinal axis of the pulling electrode 71 which can lead, in certain circumstances, to the sample molecule ions not reaching the ion detector 67 of the reflectron 56 or even the inlet tube 68 of the reflectron 56.

In the embodiment illustrated in FIGS. 1 and 2, on the other hand, it is possible, due to a corresponding design of the electrical pulling field, to have the ion paths 130 intersecting essentially at one point on the longitudinal axis of the pulling electrode 71, namely at the focal point 74 of the ion einzel lens 69. The ion paths 130 extending through the focal point 74 are, along their further course, parallelized with the axis of the entry tube 68 and, therefore, with the axis of the reflectron 56 by the electrical field of the ion einzel lens 69 which is illustrated in FIG. 2 by the representation of several equipotential surfaces 131.

Those sample molecule ions having paths which do not extend through the focal point 74 and have not therefore been parallelized with the axis of the reflectron 56 by the ion einzel lens 69 are kept away from the entry tube 68 of the reflectron 56 by the apertured partition 73. In addition, the apertured partition 73 sees to it that only a few neutral particles can pass from the stream of carrier gas 120 or from the residual gas in the vacuum chamber 12 through the pulling electrode 71 and into the reflectron 56 and impair the vacuum generated in it.

The approximate parallelization of the ion paths 130 by the ion einzel lens 69 allows the extension of the ionization zone 126 to be increased not only along the axis of the stream of carrier gas 120 but also along the optical axis 106 of the laser beam 110 and, therefore, the sensitivity of the apparatus 10 to be increased without too great a divergence of the ion beam passing through the entry tube 68 into the reflectron 56 having to be accepted.

The sample molecule ions which have passed through the entry tube 68 into the reflectron 56 first travel at a constant speed through the detector tube 66 and a field-free region in the half of the vacuum tube 58 facing the vacuum chamber 12. The time required to fly this distance is reciprocal to the speed which the sample molecule ions have reached due to acceleration in the electrical pulling field, and increases accordingly with a growing mass of the sample molecule ions.

After flying through the field-free region the sample molecule ions reach the area between the retarding electrodes 62, the positive electrical potentials of which increase with increasing distance from the vacuum chamber 12 and stepwise from one respective retarding electrode 62 to the adjacent retarding electrode 62 so that the retarding electrodes 62 together generate an electrical retarding field for the incoming sample molecule ions.

In this electrical retarding field, the sample molecule ions are retarded until they reach points of reversal, from where they are again accelerated in the direction towards the detector tube 66 and leave the retarding field again with the same speed as that at which they entered this field, but in the reverse direction. The holding time in the electrical retarding field increases yet again with a growing mass of the sample molecule ions.

Since the sample molecule ions generally have small, but not infinitesimal speed components at right angles to the axis of the reflectron 56, the ion paths 130 are not reflected exactly back into themselves but the sample molecule ions, after again passing through the field-free region in the half of the vacuum tube 58 facing the vacuum chamber 12 and in the detector tube 66 at a constant speed, reach the ion detector 67 which supplies a time-resolved electrical ion signal which is proportional to the momentary ion flow. By allocating this ion signal to the time which has passed since the triggering of the laser pulse and is determined with the aid of the timer, the dependence of the ion signal on the total flight time of the sample molecule ions can be determined. The total flight time of a sample molecule ion is proportional to the root of its mass.

Figure 4:
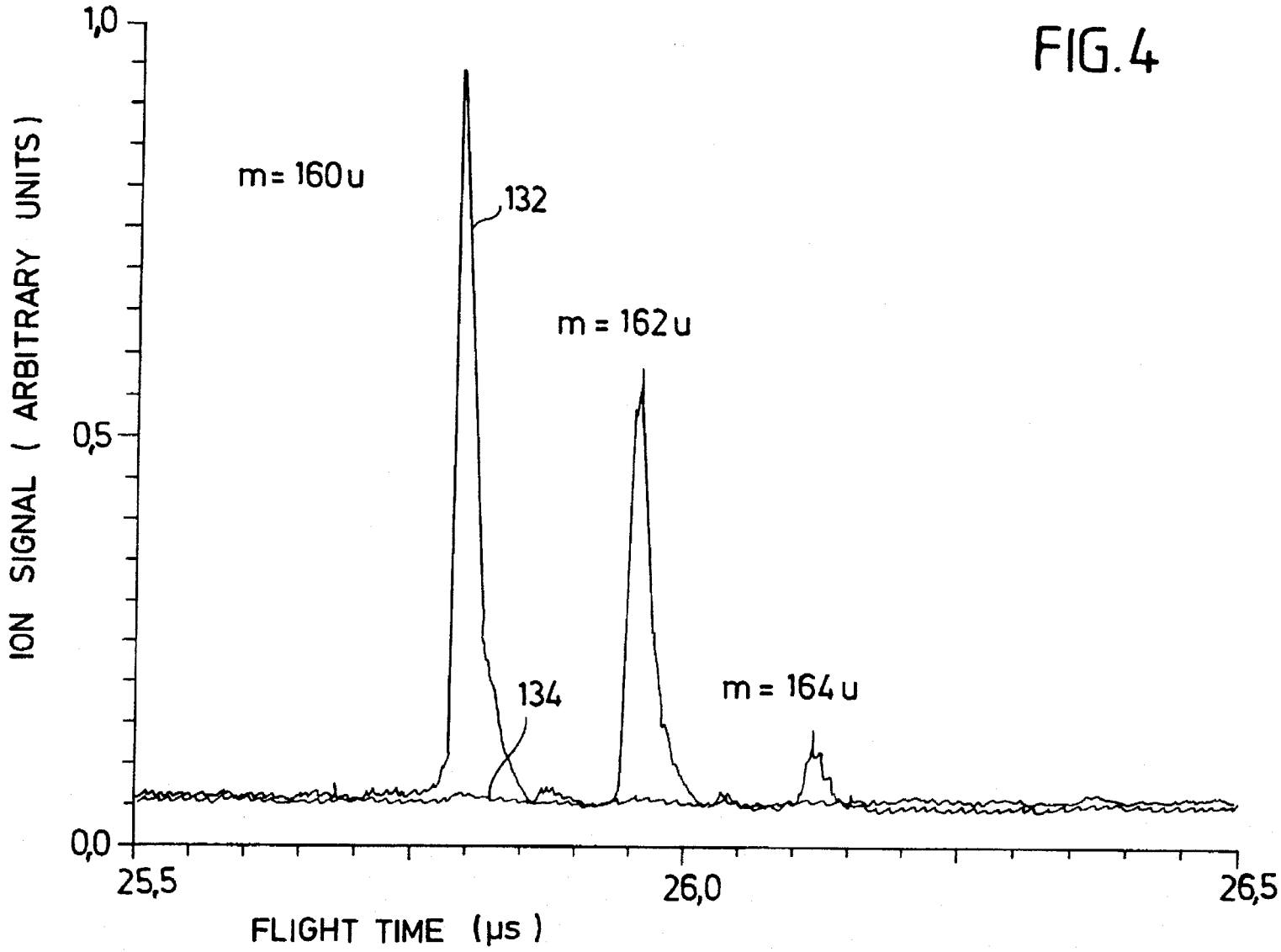
FIG. 4 shows two mass spectra obtained with the inventive apparatus from FIGS. 1 and 2 for 2,5-dichlorotoluene at two different wavelengths for the photons used for ionization.

To improve the signal-noise ratio, the time responses of the ion signals which are determined for numerous nozzle pulses or laser pulses are averaged. FIG. 4 shows a resonant ion signal flight time spectrum 132 obtained in this way with the inventive apparatus 10 for 2,5-dichlorotoluene and a non-resonant ion signal flight time spectrum 134 likewise obtained for 2,5-dichlorotoluene.

The resonant spectrum 132 was recorded at a laser wavelength of 279.6 nm, at which the ionization probability for 2,5-dichlorotoluene is high. The ionized sample molecule ions generate in the ion detector 67 an ion signal having clearly visible peaks at three different flight times which can be allocated to the molecule ion masses having 160, 162 and 164 atomic units, respectively. These masses correspond to 2,5-dichlorotoluene having two Cl atoms of the isotope $^{35}$Cl (160 atomic units), one Cl atom each of the isotopes $^{35}$Cl and $^{37}$Cl (162 atomic units) or two Cl atoms of the isotope $^{37}$Cl (164 atomic units).

The non-resonant spectrum 134 was recorded at a laser wavelength of 279.5 nm. Due to the sharp definition of the optical transition in the sample molecule, the ionization probability for 2,5-dichlorotoluene at this wavelength is already infinitely small so that practically no sample molecules are ionized and the ion signal supplied by the ion detector 67 merely corresponds to the background noise.

Due to the combination of selective ionization and determination of mass, not only isomers but also isotopes can be detected independently of one another. This is of decisive significance since the isomers of organic compounds can differ clearly from one another, for example, with respect to their toxicity.

Due to the systematic recording of spectrum libraries for gas mixtures relevant for a specific use, laser wavelengths can be determined, at which the types of sample molecule to be detected can be measured to an adequately sensitive degree and free of interferences. This means that those wavelengths which are in the tuning range of the available laser system can be selected for the photoionization.

In conjunction with a suitable sample taking and, if required, sample enriching system, an inventive apparatus 10 which is tailored to the respective field of application is suitable for numerous measuring tasks in the field of industrial processing and process control as well as in the field of environmental monitoring.

Figure 5:
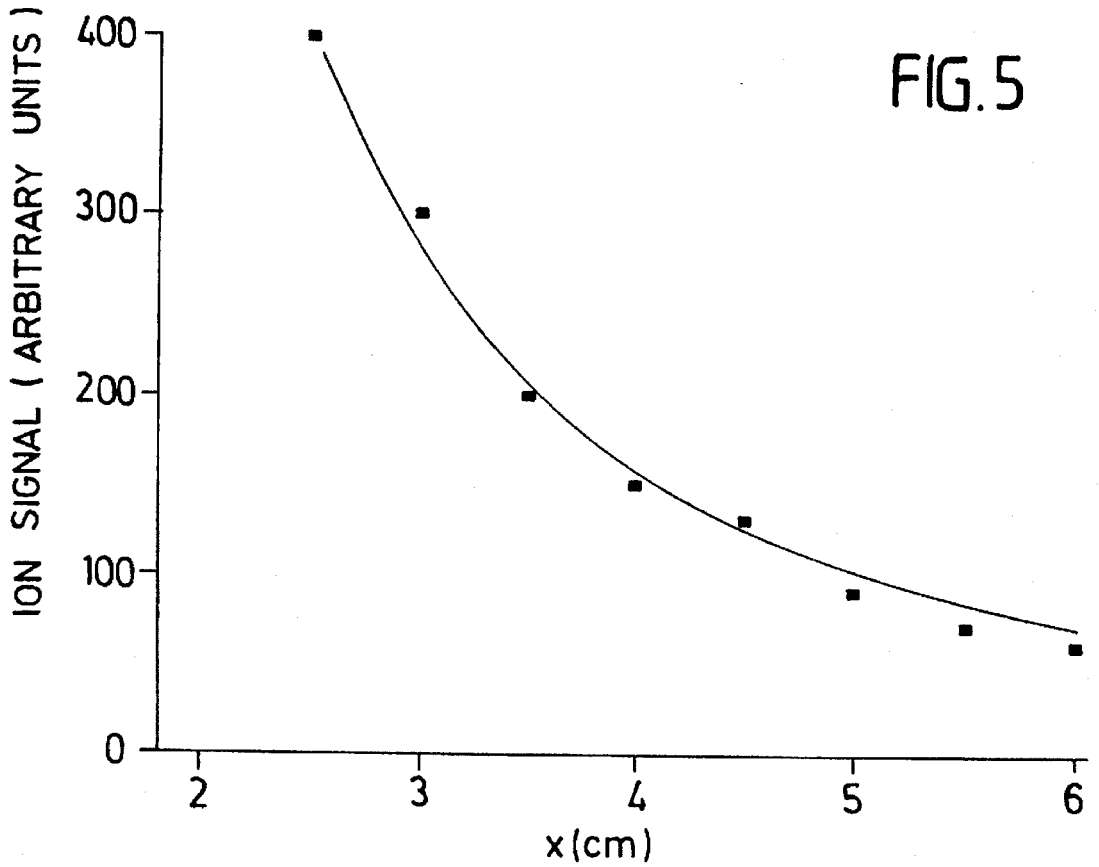
FIG. 5 shows the dependence of the intensity of the ion signal on the average distance of the ionization zone from the exit aperture of the nozzle.

FIG. 5 clearly shows how the intensity of a resonant ion signal greatly increases with a decreasing average distance x of the ionization zone 126 from the exit aperture 44. The squares represent points of measurement, the solid line corresponds to the theoretical dependence proportional to $x^{-2}$.

Figure 6:
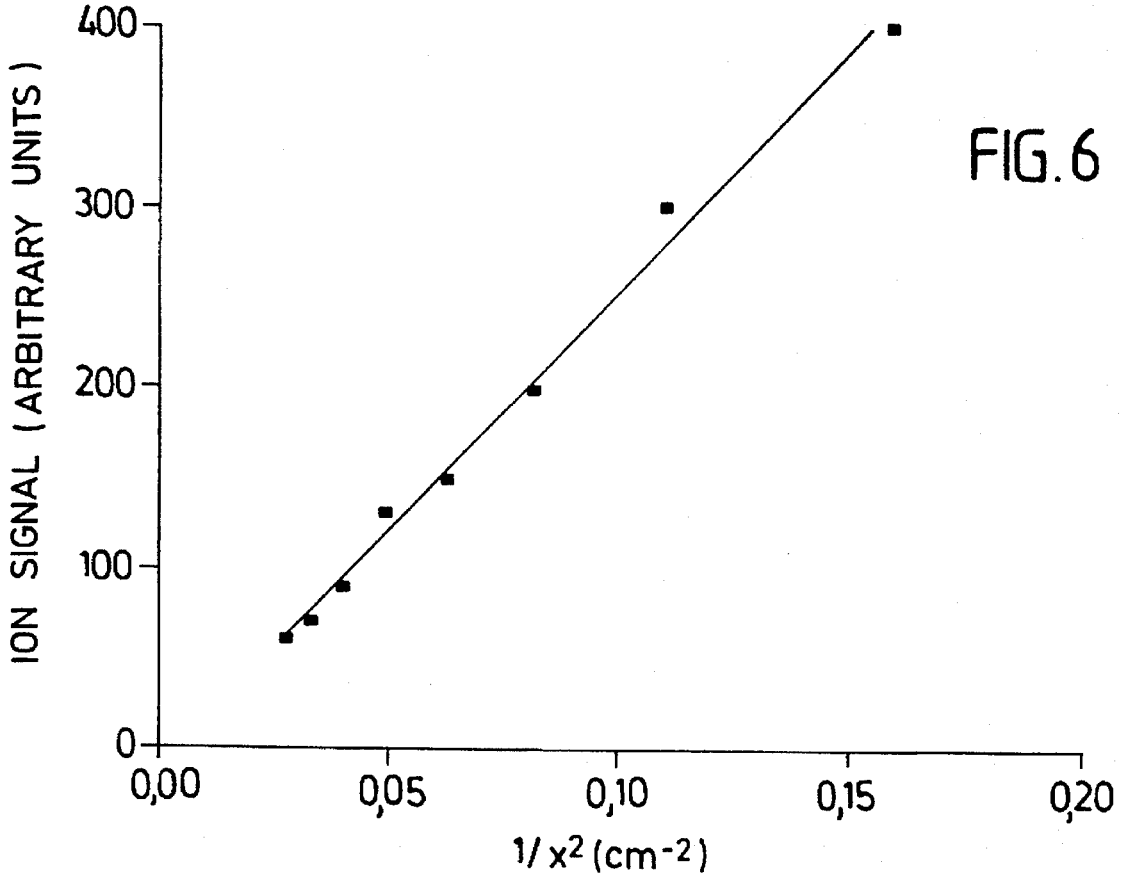
FIG. 6 shows the dependence of the intensity of the ion signal on the reciprocal value of the square average distance of the ionization zone from the exit aperture of the nozzle.

FIG. 6 illustrates the same points of measurement (squares) as in FIG. 5 with the ion signal plotted against the reciprocal value of the square average distance of the ionization zone 126 from the exit aperture 44. In this graph, a straight line corresponds to the theoretical dependence proportional to $x^{-2}$. It can be concluded from the fact that the points of measurement are actually located to a good approximation on a straight line that the increase in the sensitivity is to be attributed to the physical effect described above and is not ruined by interference effects, such as, for example, by greater scattering of carrier gas particles due to the higher density of the stream of carrier gas 120 at shorter distances x.

Figure 7:
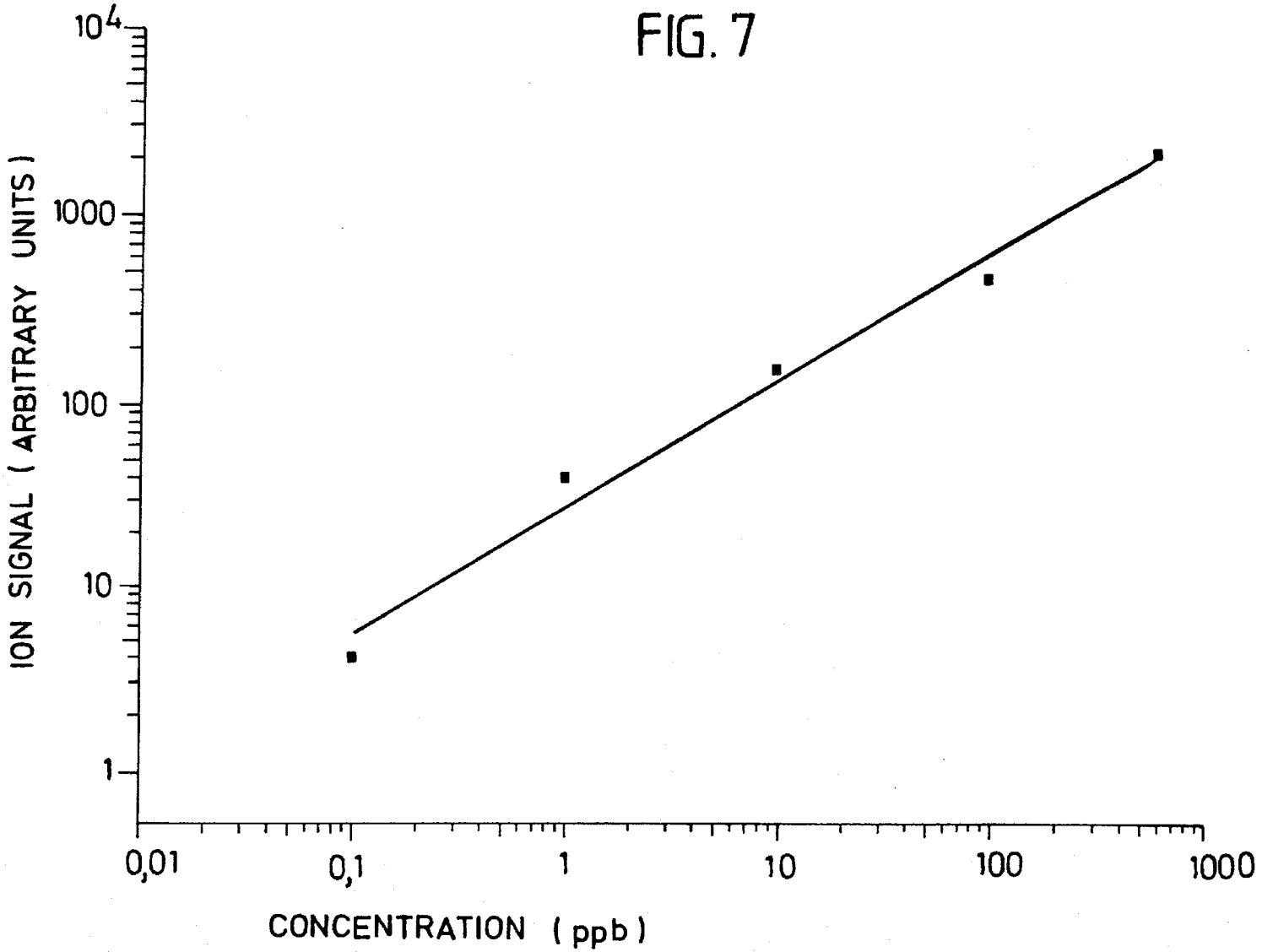
FIG. 7 shows a log-log plotting of the dependence of the intensity of the ion signal on the concentration of the sample molecules (dichlorotoluene) in the carrier gas.

Finally, FIG. 7 shows the dependence of a resonant ion signal on the concentration of the sample molecules in a log-log plotting for dichlorotoluene at a distance x of the ionization zone 126 from the exit aperture 44 of the nozzle 40 of 2.5 cm. The detection limit reached with the inventive apparatus 10 is at 0.1 ppb at a signal-noise ratio of one and a measuring time of 10 s, in comparison to 17 ppb with a measuring arrangement according to the state of the art (cf. Cool et al., Ber. Bunsenges. Phys. Chem. 97 (1993), pg. 1516).

Furthermore, FIG. 7 shows that the inventive apparatus 10 allows a quantitative detection of the sample molecules in a very broad range of concentrations which comprises at least four orders of magnitude.

The reflectron 56 is particularly suitable for achieving a high mass resolution since it minimizes the differences in flight time between sample molecule ions which have the same mass but are ionized at varying distances from the pulling electrode 71 and therefore absorb varying energies from the electrical pulling field.

Those sample molecule ions which have a type of ionization located further away from the pulling electrode 71 and are therefore accelerated by the pulling field to a higher speed cover the distances in the field-free regions of the reflectron 56 in a shorter time than those sample molecule ions which have a type of ionization located closer to the pulling electrode 71. Instead, they stay, however, for a longer time in the retarding field generated by the retarding electrodes 62 since they have to be retarded with the same delay as the slower sample molecule ions from a higher initial speed down to the speed zero at the point of reversal. To illustrate this, FIG. 1 shows the short path 130*a* of a slow sample molecule ion and the long path 130*b* of a fast sample molecule ion.

By suitably coordinating the distances to be covered in the field-free region by the sample molecule ions with the strength of the electrical retarding field it is, therefore, possible for the entire flight time of the sample molecule ions to be essentially independent of the distance of their type of ionization from the pulling electrode 71. This makes it possible to increase the extension of the ionization zone 126 transversely to the axis of the stream of carrier gas 120 which, again, increases the number of the sample molecule ions generated and, therefore, the sensitivity for the detection of the sample molecules.

On the other hand, ions originating from the counterelectrode 88 do not reach the ion detector 67 since they gain so much kinetic energy in the electrical pulling field that they are not completely retarded by the retarding field of the reflectron 56 and are not, therefore, reflected.

The stream of carrier gas 120 which takes the non-ionized sample molecule ions along with it passes through the exit aperture 100 and through the lower section 48 of the vacuum chamber 12 to the first vacuum pump which removes the carrier gas molecules and the non-ionized sample molecules from the vacuum chamber 12 in order to maintain the required vacuum.

Since a skimmer is omitted due to the small distance between the ionization zone 126 and the exit opening 44, there is no possibility to connect a further vacuum pump between the skimmer and the exit aperture 44 of the nozzle 40. In order to ensure that the first vacuum pump can maintain the vacuum in the vacuum chamber 12 on its own, it is favorable to operate the pulsed valve nozzle 40 with a pulse-pause ratio of less than 0.15, preferably less than 0.075.

At the end of a pulse, typically after an opening time of approximately 150 μs, the valve nozzle 40 is closed and the timer stopped at the end of the maximum ion flight time. During the pause following the pulse, the first vacuum pump and the second vacuum pump remove residual carrier gas and sample molecules from the vacuum chamber 12 or from the vacuum tube 58, whereupon a new measuring cycle begins with the opening of the valve nozzle 40.

The present disclosure relates to the subject matter disclosed in German application No. P 44 41 972.4 of Nov. 25, 1994, the entire specification of which is incorporated herein by reference.

We claim:

1. Process for detecting sample molecules in a carrier gas, wherein a divergent stream of carrier gas is generated by means of expansion of the carrier gas through a nozzle into a vacuum, the sample molecules are ionized selectively to form sample molecule ions in an ionization zone of the stream of carrier gas by absorption of photons and the sample molecule ions are drawn by an electrical pulling field into a mass spectrometer and detected in the mass spectrometer, characterized in that a continuum zone of the stream of carrier gas where the temperature of the carrier gas decreases with increasing distance (x) from an outlet aperture of the nozzle, a molecular beam zone of the stream of carrier gas where the temperature of the carrier gas essentially decreases no further with increasing distance (x) from the exit aperture of the nozzle, and a boundary between the continuum zone and the molecular beam zone are determined and that the sample molecules are ionized in an ionization zone near to the boundary between the continuum zone and the molecular beam zone.

2. Process as defined in claim 1, characterized in that a distance ($x_T$) of the boundary between the continuum zone and the molecular beam zone from the exit aperture of the nozzle is determined and that the sample molecules are ionized at a distance (x) from the exit aperture of the nozzle of between approximately 0.5 $x_T$ and approximately 3 $x_T$.

3. Process as defined in claim 2, characterized in that the sample molecules are ionized at a distance (x) from the exit aperture of the nozzle of between approximately 0.8 $x_T$ and approximately 2 $x_T$, preferably between approximately 0.9 $x_T$ and 1.5 $x_T$.

4. Process as defined in claim 1, characterized in that the sample molecules are ionized at a distance (x) from the exit aperture of the nozzle of less than approximately 7 cm, preferably less than approximately 3 cm.

5. Process as defined in claim 1, characterized in that the electrical pulling field is generated by means of a snout-shaped pulling electrode having an external diameter smaller than approximately 3 cm, preferably smaller than approximately 2 cm.

6. Process as defined in claim 1, characterized in that a pulsed stream of carrier gas is generated by means of a pulsed nozzle.

7. Process as defined in claim 4, characterized in that a pulsed stream of carrier gas is generated with a pulse-pause ratio of less than approximately 0.15, preferably less than approximately 0.05.

8. Process as defined in claim 1, characterized in that the electrical pulling field is shielded by an electrostatic shield arranged between the nozzle and a pulling electrode generating the electrical pulling field.

9. Process as defined in claim 8, characterized in that the electrostatic shield encloses the pulling electrode.

10. Process as defined in claim 9, characterized in that the electrostatic shield encloses the pulling electrode rotationally symmetric to its longitudinal axis.

11. Process as defined in claim 8, characterized in that the electrostatic shield allows carrier gas particles to pass through to a large extent.

12. Process as defined in claim 9, characterized in that the electrostatic shield encloses in addition a counterelectrode generating the pulling field together with the pulling electrode.

13. Process as defined in claim 9, characterized in that the stream of carrier gas enters the electrostatic shield through an inlet aperture and exits from the electrostatic shield through an exit aperture.

14. Process as defined in claim 1, characterized in that a pulling field essentially antisymmetric to a plane extending through the axis of the stream of carrier gas is generated by means of a pulling electrode and a counterelectrode essentially symmetric to the pulling electrode.

15. Process as defined in claim 1, characterized in that the pulling field is generated by means of a counterelectrode with an inlet aperture and that electrons released during the ionization of the sample molecules are drawn into the counterelectrode through the inlet aperture by the pulling field.

16. Process as defined in claim 1, characterized in that the electrical pulling field guides the sample molecule ions from the ionization zone onto paths intersecting in the interior of a pulling electrode essentially at a common point of intersection on the longitudinal axis of the pulling electrode generating the electrical pulling field.

17. Process as defined in claim 16, characterized in that particles having paths not extending through the point of intersection are kept away from the mass spectrometer by means of an apertured partition.

18. Process as defined in claim 1, characterized in that a field forming electrode at ground potential and coaxial to a pulling electrode generating the electrical pulling field increases the curvature of the equipotential surfaces of the pulling field between the ionization zone and the pulling electrode.

19. Process as defined in claim 1, characterized in that the sample molecules drawn into the mass spectrometer are directed by an ion optical means onto paths essentially parallel to the axis of the mass spectrometer.

20. Process as defined in claim 19, characterized in that the electrical pulling field guides the sample molecule ions from the ionization zone onto paths intersecting in the interior of a pulling electrode essentially at a common point of intersection on the longitudinal axis of the pulling electrode generating the electrical pulling field.

21. Process as defined in claim 1, characterized in that a reflectron is used as mass spectrometer.

22. Process as defined in claim 1, characterized in that a nozzle made of electrically non-conducting material is used.

23. Apparatus for detecting sample molecules in a carrier gas, comprising a nozzle for generating a divergent stream of carrier gas by means of expansion of the carrier gas into a vacuum, a means for the selective ionization of the sample molecules to form sample molecule ions in an ionization zone of the stream of carrier gas by absorption of photons, a mass spectrometer and a means for generating an electrical pulling field drawing the sample molecule ions into the mass spectrometer with a pulling electrode, characterized in that the ionization zone (126) is arranged near to a boundary determined for the stream of carrier gas (120) between a continuum zone (122) determined for the stream of carrier gas (120) where the temperature of the carrier gas decreases with increasing distance (x) from an exit aperture (44) of the nozzle (40) and a molecular beam zone (124) determined for the stream of carrier gas (120) where the temperature of the carrier gas essentially decreases no further with increasing distance (x) from the exit aperture (44) of the nozzle (40).

24. Apparatus as defined in claim 23, characterized in that the ionization zone has a distance (x) from the exit aperture (44) of the nozzle (40) of between approximately 0.5 $x_T$ and approximately 3 $x_T$, wherein $x_T$ is the distance determined for the stream of carrier gas (120) of the boundary between the continuum zone (122) and the molecular beam zone (124) from the exit aperture (44) of the nozzle (40).

25. Apparatus as defined in claim 24, characterized in that the ionization zone (126) has a distance (x) from the exit aperture (44) of the nozzle (40) of between approximately 0.8 $x_T$ and approximately 2 $x_T$, preferably between 0.9 $x_T$ and 1.5 $x_T$.

26. Apparatus as defined in claim 23, characterized in that the ionization zone (126) has a distance (x) from the exit aperture (44) of the nozzle (40) of less than approximately 7 cm, preferably less than approximately 3 cm.

27. Apparatus as defined in claim 23, characterized in that the means for generating the electrical pulling field comprises a snout-shaped pulling electrode (71) having an external diameter smaller than approximately 3 cm, preferably smaller than approximately 2 cm.

28. Apparatus as defined in claim 23, characterized in that the nozzle (40) is a pulsed nozzle for generating a pulsed stream of carrier gas (120).

29. Apparatus as defined in claim 28, characterized in that a pulsed stream of carrier gas (120) with a pulse-pause ratio of less than approximately 0.15, preferably less than approximately 0.05, is generatable by means of the pulsed nozzle (40).

30. Apparatus as defined in claim 23, characterized in that the apparatus (10) comprises an electrostatic shield (96) arranged between the nozzle (40) and the pulling electrode (71).

31. Apparatus as defined in claim 30, characterized in that the electrostatic shield (96) encloses the pulling electrode (71).

32. Apparatus as defined in claim 31, characterized in that the electrostatic shield (96) encloses the pulling electrode (71) rotationally symmetric to its longitudinal axis.

33. Apparatus as defined in claim 30, characterized in that the electrostatic shield (96) is permeable to a large extent to carrier gas particles.

34. Apparatus as defined in claim 31, characterized in that the electrostatic shield (96) encloses in addition a counterelectrode (88) generating the pulling field together with the pulling electrode (71).

35. Apparatus as defined in claim 30, characterized in that the electrostatic shield (96) has an inlet aperture (98) and an exit aperture (100) for the stream of carrier gas (120).

36. Apparatus as defined in claim 23, characterized in that the means for generating the electrical pulling field comprises a counterelectrode (88) essentially symmetric to the pulling electrode (71) in relation to a plane extending through the axis of the stream of carrier gas (120).

37. Apparatus as defined in claim 23, characterized in that the means for generating the electrical pulling field comprises a counterelectrode (88) with an inlet aperture (92) for the entry into the counterelectrode (88) of electrons released during the ionization of the sample molecules.

38. Apparatus as defined in claim 23, characterized in that the pulling electrode (71) has essentially no outer surfaces with surface perpendiculars pointing towards the ionization zone (126).

39. Apparatus as defined in claim 23, characterized in that the means for generating the electrical pulling field comprises a counterelectrode (88) having essentially no outer surfaces with surface perpendiculars pointing towards the pulling electrode (71).

40. Apparatus as defined in claim 23, characterized in that the means for generating the electrical pulling field is designed such that the electrical pulling field guides the sample molecule ions from the ionization zone (126) onto paths (130) intersecting in the interior of the pulling electrode (71) essentially at a common point of intersection (74) on the longitudinal axis of the pulling electrode (71).

41. Apparatus as defined in claim 40, characterized in that the apparatus (10) comprises an apertured partition arranged within the pulling electrode (71), said partition keeping away from the mass spectrometer (56) particles having paths (130) not extending through the point of intersection (74).

42. Apparatus as defined in claim 23, characterized in that the means for generating the electrical pulling field comprises a field forming electrode (80) at ground potential and coaxial to the pulling electrode (71) for increasing the curvature of equipotential surfaces (128) of the pulling field between the ionization zone (126) and the pulling electrode (71).

43. Apparatus as defined in claim 23, characterized in that the means for generating the electrical pulling field comprises a counterelectrode (88) and a field forming electrode (94) at ground potential and coaxial to the counterelectrode (88) for increasing the curvature of equipotential surfaces (128) of the pulling field between the ionization zone (126) and the counterelectrode (88).

44. Apparatus as defined in claim 23, characterized in that the apparatus (10) comprises an ion optical means (69) directing the sample molecule ions drawn into the mass spectrometer (56) onto paths essentially parallel to the axis of the mass spectrometer (56).

45. Apparatus as defined in claim 44, characterized in that the means for generating the electrical pulling field is designed such that the electrical pulling field guides the sample molecule ions from the ionization zone (126) onto paths (130) intersecting in the interior of the pulling electrode (71) essentially at a common point of intersection (74) on the longitudinal axis of the pulling electrode (71) and that the ion optical means (69) is arranged between the pulling electrode (71) and the mass spectrometer (56) such that its focal point (74) coincides with the point of intersection of the paths (130) of the sample molecule ions.

46. Apparatus as defined in claim 23, characterized in that the mass spectrometer (56) is a reflectron.

47. Apparatus as defined in claim 23, characterized in that the nozzle (40) consists of an electrically non-conducting material.

* * * * *